US011834759B2

(12) United States Patent
Meissner et al.

(10) Patent No.: US 11,834,759 B2
(45) Date of Patent: Dec. 5, 2023

(54) SPINNING POSITION WITH A CLEANING NOZZLE AND METHOD OF CLEANING A YARN FORMING ELEMENT

(71) Applicant: Saurer Intelligent Technology AG, Arbon (CH)

(72) Inventors: Sarah Meissner, Geilenkirchen (DE); Chandrassekaran Seshayer, Herzogenrath (DE); Karoline Günther, Mönchengladbach (DE)

(73) Assignee: Saurer Intelligent Technology AG, Arbon (CH)

( * ) Notice: Subject to any disclaimer, the term of this patent is extended or adjusted under 35 U.S.C. 154(b) by 0 days.

(21) Appl. No.: 17/554,174

(22) Filed: Dec. 17, 2021

(65) Prior Publication Data

US 2022/0195634 A1 Jun. 23, 2022

(30) Foreign Application Priority Data

Dec. 18, 2020 (EP) ..... 20215332

(51) Int. Cl.
*D01H 11/00* (2006.01)
*D01H 4/02* (2006.01)
*D01H 4/22* (2006.01)

(52) U.S. Cl.
CPC ..... *D01H 11/005* (2013.01); *D01H 4/02* (2013.01); *D01H 4/22* (2013.01); *D01H 2700/21* (2013.01)

(58) Field of Classification Search
CPC ..... D01H 1/115; D01H 4/02; D01H 11/005; D01H 11/006
See application file for complete search history.

(56) References Cited

U.S. PATENT DOCUMENTS 4,107,911 A * 8/1978 Yamana ..... D01H 1/115 57/328
4,412,413 A * 11/1983 Sakai ..... D01H 1/115 57/328

(Continued)

FOREIGN PATENT DOCUMENTS

CH 713499 A2 8/2018
CN 101994172 A 3/2011

(Continued)

OTHER PUBLICATIONS

Machine Translation JP2011038210A, retrieved Jan. 19, 2023 (Year: 2023).*

(Continued)

*Primary Examiner* — Shaun R Hurley
(74) *Attorney, Agent, or Firm* — Nelson Mullins Riley & Scarborough LLP

(57) ABSTRACT

A spinning position of an air-spinning machine and method of cleaning a yarn forming element of an air spinning nozzle are provided. The spinning position has an air spinning nozzle with a yarn forming element arranged within a vortex chamber for producing a yarn from a fibre band supplied to the air spinning nozzle, in which case the air spinning nozzle can be transferred from a closed state for yarn formation to an open state in which the yarn forming element can be cleaned. At least one cleaning nozzle for cleaning the yarn forming element in the open state of the air spinning nozzle is arranged at the spinning position, the cleaning nozzle being positioned and/or aligned or positionable and/or alignable, such that, at least in the open state of the air spinning nozzle, the yarn forming element can have a cleaning medium applied to it through the cleaning nozzle.

14 Claims, 4 Drawing Sheets

(56) References Cited

U.S. PATENT DOCUMENTS

| | | | | | |
|---|---|---|---|---|---|
| 5,177,950 | A * | 1/1993 | Fowler, Jr. | D01H 11/006 | 239/602 |
| 5,313,775 | A * | 5/1994 | Binder | D01H 11/005 | 57/305 |
| 5,361,572 | A * | 11/1994 | Uematsu | D01H 11/006 | 57/305 |
| 5,666,996 | A * | 9/1997 | Bollier | D03J 1/002 | 15/345 |

FOREIGN PATENT DOCUMENTS

| | | | | |
|---|---|---|---|---|
| CN | 104975380 | A | 10/2015 | |
| CN | 105803589 | A | 7/2016 | |
| DE | 102017113257 | A1 | 12/2018 | |
| EP | 2620532 | A1 * | 7/2013 | D01H 1/115 |
| EP | 3048191 | A1 | 7/2016 | |
| EP | 4015681 | A1 | 6/2022 | |
| JP | 2011038210 | A | 2/2011 | |

OTHER PUBLICATIONS

European Search Report, European Application No. EP20215332, dated May 10, 2021, 1 page.
Office Action from Indian Patent Application No. 202124057811, dated Jul. 4, 2022, all enclosed pages cited.
Office Action from corresponding Chinese Patent Application No. 202111550502.8, dated Dec. 19, 2022, all enclosed pages cited (no English translation available).

* cited by examiner

SPINNING POSITION WITH A CLEANING NOZZLE AND METHOD OF CLEANING A YARN FORMING ELEMENT

CROSS-REFERENCE TO RELATED APPLICATION

This application claims priority from EP 20215332.6, filed Dec. 18, 2020, entitled "Spinnstelle mit einer Reinigungsdüse und Verfahren zum Reinigen eines Garnbildungselements", the entire contents of which are incorporated herein by reference.

FIELD OF THE INVENTION

The invention relates to a spinning position of an air-spinning machine, and to a method of cleaning a yarn forming element of an air spinning nozzle.

BACKGROUND OF THE INVENTION

Generally, in air spinning, a sliver is drawn in a defined manner according to the yarn count to be achieved by means of a multiple roller drafting system and then fed to an air spinning nozzle. Inside a vortex chamber of the air spinning nozzle, the outer fibres of the fibre band are wound around an inner fibre core by means of a vortex air flow generated by air jets in the region of an inlet mouth of a yarn forming element of the air spinning nozzle, so that an air-spun yarn-specific yarn structure of a parallel yarn core and wrap fibres lying at a certain angle results, the wrap fibres being decisive for the desired strength of the yarn.

The air spinning process can in principle be carried out with fibres made of various materials, in which case both natural fibres, such as cotton and/or animal wool, and synthetic fibres, such as polyester, as well as mixtures of natural and synthetic fibres can be used. In practice, during the spinning of polymer fibres, particularly fibres made of polyester (PES), a deposit of polymer residues, polyester fibre fragments and/or finishing agents often occurs on a surface of a spinning cone of the yarn forming element. However, such deposits significantly disrupt the air spinning process and significantly reduce the spinning result and thus the yarn quality. In particular, thread breaks can occur during the spinning process due to the increased friction between the surfaces of the air spinning nozzle and the fibres. In addition, the air nozzles and other components of the air spinning nozzle can become clogged with deposits, so that the yarn obtained has a lower yarn strength and quality.

SUMMARY OF THE INVENTION

The problem addressed by the present invention is therefore one of providing a spinning position of an air-spinning machine as well as a method for cleaning a yarn forming element of an air spinning nozzle, which enable in particular long and trouble-free operation with constant quality and strength of the manufactured yarn.

The problem is solved according to the present invention by a spinning position of an air-spinning machine and a method for cleaning a yarn-forming element of an air spinning nozzle. Advantageous further developments of the present invention are stated herein.

The spinning position of an air-spinning machine according to the present invention has an air spinning nozzle with a yarn forming element arranged within a vortex chamber for manufacturing a yarn from a fibre band supplied to the air spinning nozzle, the air spinning nozzle being transferable from a closed state for yarn formation to an open state in which the yarn forming element can be cleaned. In addition, at least one cleaning nozzle for cleaning the yarn forming element in the open state of the air spinning nozzle is associated with the spinning position or is arranged at the spinning position, the cleaning nozzle being designed, in particular positioned and/or aligned or positionable and/or alignable, in such a way that, at least in the open state of the air spinning nozzle, the yarn forming element can be acted upon by the cleaning nozzle with a cleaning medium.

In the method according to the present invention for cleaning a yarn forming element of an air spinning nozzle, first the air spinning nozzle having a vortex chamber is opened to make the yarn forming element arranged in the vortex chamber accessible, then and/or simultaneously the yarn forming element and/or a cleaning nozzle is moved into a cleaning position and finally the yarn forming element is acted upon by at least one cleaning medium.

The inventors have recognised that regular cleaning of the yarn forming element permits long and trouble-free operation while maintaining the quality and strength of the yarn manufactured, such cleaning being possible in a particularly simple manner and without interfering with the other components of the air-spinning machine when the air spinning nozzle is in an open position, for example in the course of a spinning interruption after a thread break or a scheduled cut of the yarn. In this respect, the invention advantageously permits an increase in strength and greater cleanliness of the spun yarns.

An air spinning nozzle is initially understood to mean any spinning nozzle which, by means of at least one air flow, interlaces fibres, in particular wrap fibres, around an internal fibre core to form a thread or yarn. The yarn formation process takes place in the area of a vortex chamber of the air spinning nozzle, in which at least one yarn forming element is arranged. The air spinning nozzle is encompassed by a spinning position, each spinning position for manufacturing a yarn from a fibre band supplied to the air spinning nozzle. The air spinning nozzle has an inlet for the fibre band, the internal vortex chamber, one or more yarn-forming or spinning elements arranged at least in sections in the vortex chamber, and an outlet for the yarn produced inside the vortex chamber. In addition, the air spinning nozzle preferably has a plurality of air nozzles which open into the vortex chamber and which are particularly preferably in fluid connection with at least one air supply line, in which case during a spinning operation of the spinning position, in which the yarn is produced by means of the air spinning nozzle, compressed air provided by the air supply line flows into the vortex chamber via the air nozzles in order to produce a vortex air flow within the vortex chamber for air spinning of the supplied fibre band into a yarn.

A yarn or thread in the sense of the present invention is a fibre band in which at least a portion of the fibres are wound around an internal fibre core. In this context, a yarn may also be a roving or a sliver for further processing, for example by means of a ring spinning machine. The fibre band and hence the yarn manufactured therefrom is preferably formed at least in part, more preferably entirely, from synthetic fibres or man-made fibres, for example polyester or polyethersulfone.

The fibre band is basically the fibre material supplied to the air spinning process, which is preferably provided as a continuous band or composite of fibres to be spun. All fibres can be made of the same material or the fibre band can contain fibres that are chemically different from one another. In principle, however, the fibres in the fibre band are not yet spun together.

The yarn forming element can be an independent component, a section of a structural unit or a functional unit directly involved in the air spinning process. In this regard, the yarn forming element can be formed in one piece or in multiple pieces. Preferably, the yarn forming element has a spinning cone or a portion of a spinning cone and more preferably, the yarn forming element forms the spinning cone. During the air spinning process, the yarn forming element comes into direct contact, at least in sections, with the fibres to be spun to produce the yarn and with the spun yarn.

According to the present invention, the air spinning nozzle can be transferred from a closed state of the air spinning nozzle, in which the vortex chamber is preferably formed by the air spinning nozzle and the yarn forming element arranged in the vortex chamber is surrounded by the vortex chamber, to an open state, in which the vortex chamber is preferably opened relative to the external surroundings of the air spinning nozzle and the yarn forming element is exposed for cleaning, for which purpose preferably at least a first component of the air spinning nozzle, which further preferably has the yarn forming element, can be moved relative to a further component of the air spinning nozzle. In particular, the first and second components of the air spinning nozzle have wall sections which at least partially delimit the vortex chamber when the air spinning nozzle is closed. Particularly preferably, the first component of the air spinning nozzle, which particularly preferably encompasses the yarn forming element, is thereby moved, in particular displaced and/or swivelled, relative to the second component of the air spinning nozzle, which is preferably arranged in a stationary position at the spinning position. The closed state of the air spinning nozzle is provided for yarn formation, while in the open state of the air spinning nozzle the yarn forming element is accessible for cleaning, at least in sections, and particularly preferably completely.

The opening of the air spinning nozzle and the movement of the yarn forming element and/or preferably of the cleaning nozzle can take place completely one after the other, as well as at least partially at the same time. It is also conceivable for the yarn forming element to be moved into a cleaning position at the same time as or immediately following the opening of the air-spinning nozzle, in which case a movement of the cleaning nozzle into a cleaning position is not necessary, but is preferably additionally possible.

In principle, the cleaning position is the position of the yarn forming element and/or the cleaning nozzle in which cleaning of the yarn forming element by at least one cleaning medium by means of the cleaning nozzle takes place. The cleaning position of the cleaning nozzle is preferably located outside the vortex chamber and/or opposite a surface of the yarn forming element. In this regard, the cleaning position is provided for operation of the cleaning nozzle, and preferably operation of the cleaning nozzle occurs exclusively in the cleaning position. In the cleaning position, preferably no further component of the air spinning nozzle, the spinning position and/or the air-spinning machine is arranged in an application path between an outer surface of the yarn forming element and the cleaning nozzle, of which there is at least one, particularly preferably all cleaning nozzles.

In principle, cleaning by means of the cleaning nozzle can be carried out in any manner, the method of cleaning preferably having a predetermined cleaning cycle having, in particular, a plurality of cleaning steps. In this context, cleaning preferably means removing contaminants from the yarn forming element, in particular fibre, finishing agent and/or polymer deposits. In this case, the contaminants are particularly preferably removed from the outer surface of the yarn forming element and/or at least one part of a thread take-up duct inside the yarn forming element.

According to the present invention, in order to enable cleaning of the yarn forming element, a cleaning nozzle is provided for dispensing a cleaning medium and for supplying the cleaning medium to the yarn forming element. For this purpose, the cleaning nozzle is arranged at the spinning position and/or directed towards the spinning position. Preferably, at least one cleaning nozzle is associated with two spinning positions, more preferably with a single spinning position. For this purpose, the cleaning nozzle can preferably be arranged in the area of two adjacent spinning positions in such a way that the cleaning nozzle can apply a cleaning medium to the respective yarn forming element of these two spinning positions. Further preferably, a cleaning nozzle is arranged at each spinning position. Furthermore preferably, the cleaning nozzle is a nozzle for cleaning the yarn forming element by means of a liquid and/or a gas. Accordingly, the cleaning medium can be a gas or a liquid. In addition, any mixtures of gases and liquids, in particular aerosols, foams and/or emulsions, can also conceivably be used as cleaning medium.

Although sufficient cleaning of the yarn forming element can be achieved by means of a single cleaning nozzle, more than one cleaning nozzle can also be arranged in the area of a yarn forming element, preferably with a plurality of cleaning nozzles being directed or alignable in the cleaning position towards different surface sections of the yarn forming element and/or from different directions towards the yarn forming element. Also preferably, the cleaning nozzle is formed to apply the cleaning medium to at least one surface section of the yarn forming element using atomizing technology. Particularly preferably, the cleaning nozzle has a liquid atomizer and very particularly preferably, the cleaning nozzle is formed as a liquid atomizer.

According to the present invention, the cleaning nozzle is designed, in particular positioned and/or aligned or positionable and/or alignable, in such a way that in the cleaning position the yarn forming element can have the cleaning medium applied to them. Application with cleaning medium is understood to mean that a cleaning medium is guided onto at least one part or a section of the surface of the yarn forming element.

At least one cleaning medium is preferably supplied to the cleaning nozzle via at least one cleaning medium line, which may be formed as a pure liquid line, as a pure gas line or alternatively as a mixed line. Furthermore, in particular gases and liquids can be supplied as cleaning medium via different or mutually separate lines. Preferably, in the feed direction of the cleaning medium, of which there is at least one, and particularly for each individual cleaning medium, an activating and/or metering unit is arranged upstream of the cleaning nozzle, which is particularly preferably formed as a valve and/or as an adjustable throttle, in order to be able to regulate the quantity or the flow of the cleaning medium fed to the yarn forming element in a defined manner.

In a preferred embodiment of the spinning position, at least one cleaning nozzle is arranged outside the vortex chamber and/or in a stationary position at or in the region of the spinning position, in which case a particularly simple structure can be achieved and the air spinning process is not disrupted by the cleaning nozzle. In addition, the spinning result cannot be impaired by the cleaning medium inside the vortex chamber.

Moreover, it is preferable for alternatively or additionally at least one cleaning nozzle, and in particular one further cleaning nozzle, to be movable outside the vortex chamber and/or by means of a swivelling device between a rest position and a cleaning position for cleaning the yarn forming element, thereby enabling a particularly undisturbed operation of the spinning position. The movement between the rest position and the cleaning position is preferably a displacement, in particular an extension, and/or a folding over or a swivelling. In particular, an advantageous embodiment of the spinning position with several cleaning nozzles is conceivable, in which all cleaning nozzles can preferably be stationary or movable or, in a preferred manner, at least one stationary cleaning nozzle and at least one movable cleaning nozzle can be provided for cleaning a yarn forming element.

In an advantageous further development of the spinning position, the cleaning nozzle can be positioned and aligned, in particular by means of the swivelling device, in such a way that the yarn forming element can be acted upon by the cleaning medium in the cleaning position frontally and/or laterally over at least part of its surface, in which case cleaning of the yarn forming element can be achieved in a particularly straightforward manner. In this context, frontally means in particular in a direction along a yarn take-off channel and/or towards a tip of the yarn forming element. In this context, laterally means in particular oriented from one side at right angles to a yarn take-off channel arranged centrally in the yarn forming element and/or towards a part of a preferably conically formed side surface of the yarn forming element.

Particularly preferred is an advantageous further development of the spinning position in which the cleaning nozzle can be rotated, in particular by means of the swivelling device, around the yarn forming element at least in sections, preferably completely, in order to be able to apply the cleaning medium to the surface of the yarn forming element, in particular a spinning cone surface, over the entire surface during the rotation. In this regard, the rotation of the cleaning nozzle can be at right angles to a central longitudinal axis or a yarn take-off channel of the yarn forming element, or at a constant or variable angle, with rotation along a circular path or along a circular section being preferred.

A preferred embodiment of the method for cleaning a yarn forming element provides for the cleaning nozzle for cleaning the yarn forming element to be moved by means of a swivelling device from a rest position to a cleaning position and/or from the cleaning position to the rest position after cleaning. This movement into the cleaning position can basically take place at any time. It is conceivable for moving of the yarn forming element into the cleaning position to occur with an initiation of the opening process of the air spinning nozzle, during the opening of the air spinning nozzle and/or after the opening of the air spinning nozzle. Preferably, however, the movement of the yarn forming element into the cleaning position is such that the cleaning nozzle is in the cleaning position before or at the end of the opening process, thereby enabling particularly time-efficient cleaning.

In principle, cleaning can be carried out at any time and repeated as often as required. A preferred embodiment of the method for cleaning a yarn forming element provides for the yarn forming element to be cleaned in the course of a spinning interruption, for example after at least one or each thread break, after at least one or each cut of the yarn, during a removal of a take-up package wound by means of the air-spun yarn and/or during a change of a spinning can from which the fibre band is supplied to the spinning position. Cleaning after a thread break makes it possible in particular to remove contamination as a possible cause of a thread break before the air spinning process is resumed. Cleaning after a yarn cut, during removal of the take-up package or insertion of a new empty tube into the winding device and during a spinning can change, like cleaning after a thread break, ensures a consistently high yarn quality and strength. Alternatively or in addition, cleaning can also be carried out periodically with defined interval sections which are the same or different from one another, in particular in relation to the operating time of the spinning position, the number of thread breaks, the number of yarn cuts, the number of take-up package removals or the number of empty tubes inserted, the number of spinning can changes, generally the number of spinning interruptions or spinning stops, in order to be able to guarantee regular cleaning or to be able to avoid longer periods without cleaning. Further alternatively or additionally, a cleaning can be carried out before a start-up of the spinning position after a defined downtime and/or before a shut-down of the spinning position in preparation of a defined downtime. This also ensures that these disruptive deposits in the air spinning nozzle are minimized or eliminated as far as possible when the spinning process is resumed.

A preferred embodiment of the method for cleaning a yarn forming element provides that the cleaning of the yarn forming element is performed by means of a cleaning fluid, in particular by means of an aqueous cleaning fluid, an aerosol, a foam, an emulsion or a gas as cleaning medium. By suitable selection of the cleaning medium, cleaning and in particular additional treatment of the surface of the yarn forming element can be carried out as required. For example, in particular by means of an aerosol, foam or emulsion, in addition to a cleaning effect, a defined layer with a defined effect can be applied to the surface of the yarn forming element, which can have a beneficial effect on the spinning process. Thus, the yarn forming element can be provided with an anti-adhesion layer which at least reduces, and at best prevents, particles from adhering to the yarn forming element for a certain period of time. This allows cleaning cycles of the yarn forming element to be extended.

The use of a cleaning fluid as well as an aerosol enables a particularly thorough and, above all, fast cleaning. A cleaning fluid is understood to be any fluid which has a liquid content of preferably at least 90%, more preferably at least 95% and very particularly preferably at least 98%. The fluid can particularly preferably be water. Also preferably, the cleaning medium can have at least one cleaning and/or surface-active substance, in particular at least a surfactant.

Although in principle a one-step cleaning by means of the cleaning medium is conceivable, in a preferred embodiment of the method for cleaning a yarn forming element, in a first cleaning step a cleaning fluid, an aerosol, a foam or an emulsion is directed onto the yarn forming element to remove deposits and subsequently, in a second cleaning step, a gas stream is directed onto the yarn forming element to remove moisture from the surface of the yarn forming element and/or to dry the latter, such preferred cleaning being particularly preferably carried out by means of the same cleaning nozzle. Cleaning by means of a gas stream can be carried out either by a continuous gas stream or by one or more gas pulses.

In addition, an advantageous embodiment of the process for cleaning a yarn forming element is also conceivable, in which the yarn forming element is first cleaned by means of a gas stream for removing loose particles from the surface, then by means of a cleaning fluid, an aerosol, a foam or an emulsion for loosening adhering particles, and preferably finally once again by means of a gas stream for finally cleaning and/or drying the surface of the yarn forming element. Alternatively, however, the second gas stream can be dispensed with if necessary to keep the surface of the yarn forming element moist and thereby achieve greater strength of the yarn produced by means of the yarn forming element due to an increased application of force to the surface of the yarn forming element.

According to another aspect of the present invention, the spinning position can be encompassed by a workstation of the air-spinning machine. A workstation is understood to be any position on the air-spinning machine at which an air-spun spinning thread or a yarn is produced by means of the spinning position from a fibre band supplied to the spinning position and is wound on via a winding device downstream of the spinning position in the thread path for winding on a take-up package, in particular a cross-wound package. The fibre band feed can take place via a central fibre band accumulator assigned to the air-spinning machine or via a respective fibre band accumulator assigned to the individual spinning position, such as in particular a spinning can, in which a defined quantity of fibre band is deposited in a removable manner from the spinning can. The workstation can have further fibre band or yarn treatment devices for defined and demand-driven treatment of the fibre band or the thread. For example, the workstation can have sensor systems for monitoring the fibre band feed and/or fibre band parameters as well as, or alternatively, for monitoring the thread take-off, the thread feed to the winding device, the yarn parameters, for cleaning out yarn faults and/or piecing-up after a fibre band or thread break or after a spinning can change or a take-up package removal. Furthermore, sensor systems or other devices can be assigned to the workstation in the area of the drafting system, by means of which the fibre band can be drawn in a defined manner and as required and/or provided with additional fibres, in particular from a different fibre material, a so-called core yarn.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings.

Several embodiment examples of a spinning position according to the present invention are explained in more detail below with reference to the drawings. The same reference signs are used for the same components. In the drawings.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
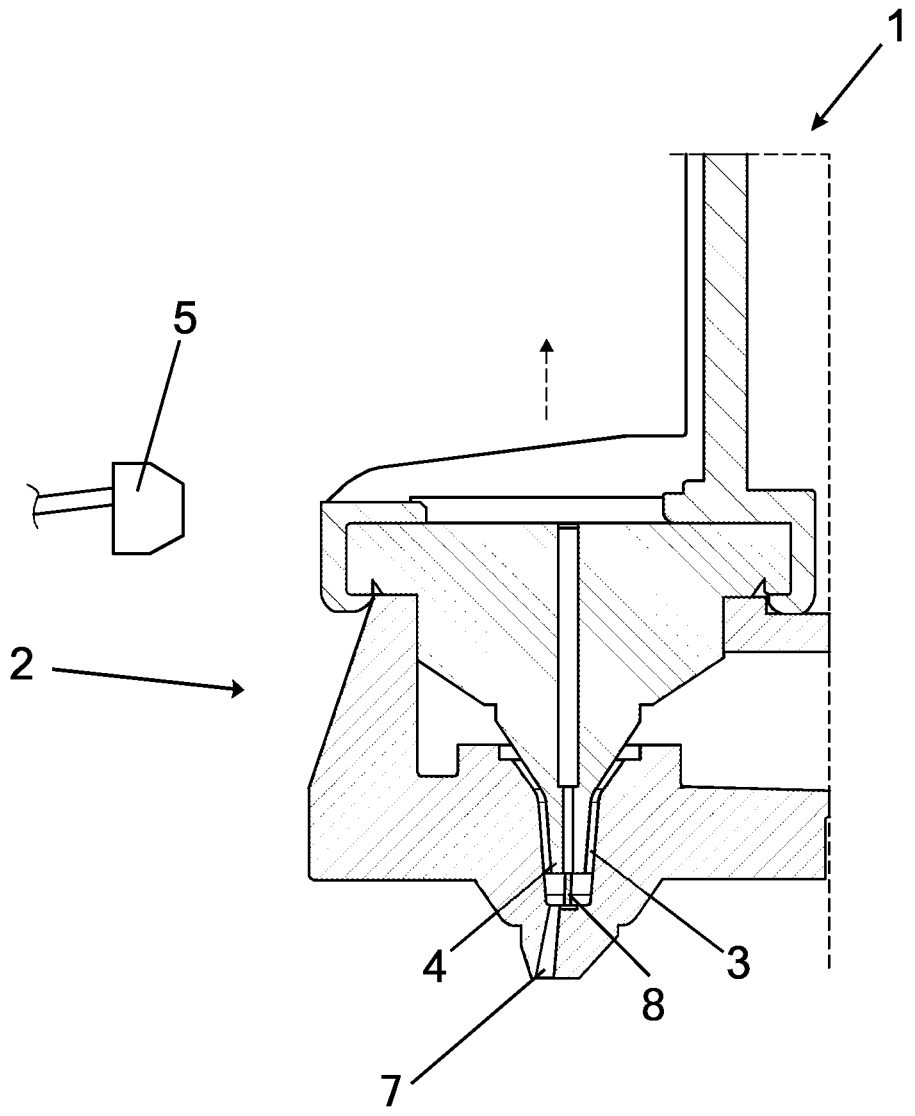
FIG. 1 shows a schematic, cross-sectional view of a first embodiment of a spinning position of an air-spinning machine having an air spinning nozzle in a closed state for yarn formation.
Figure 2:
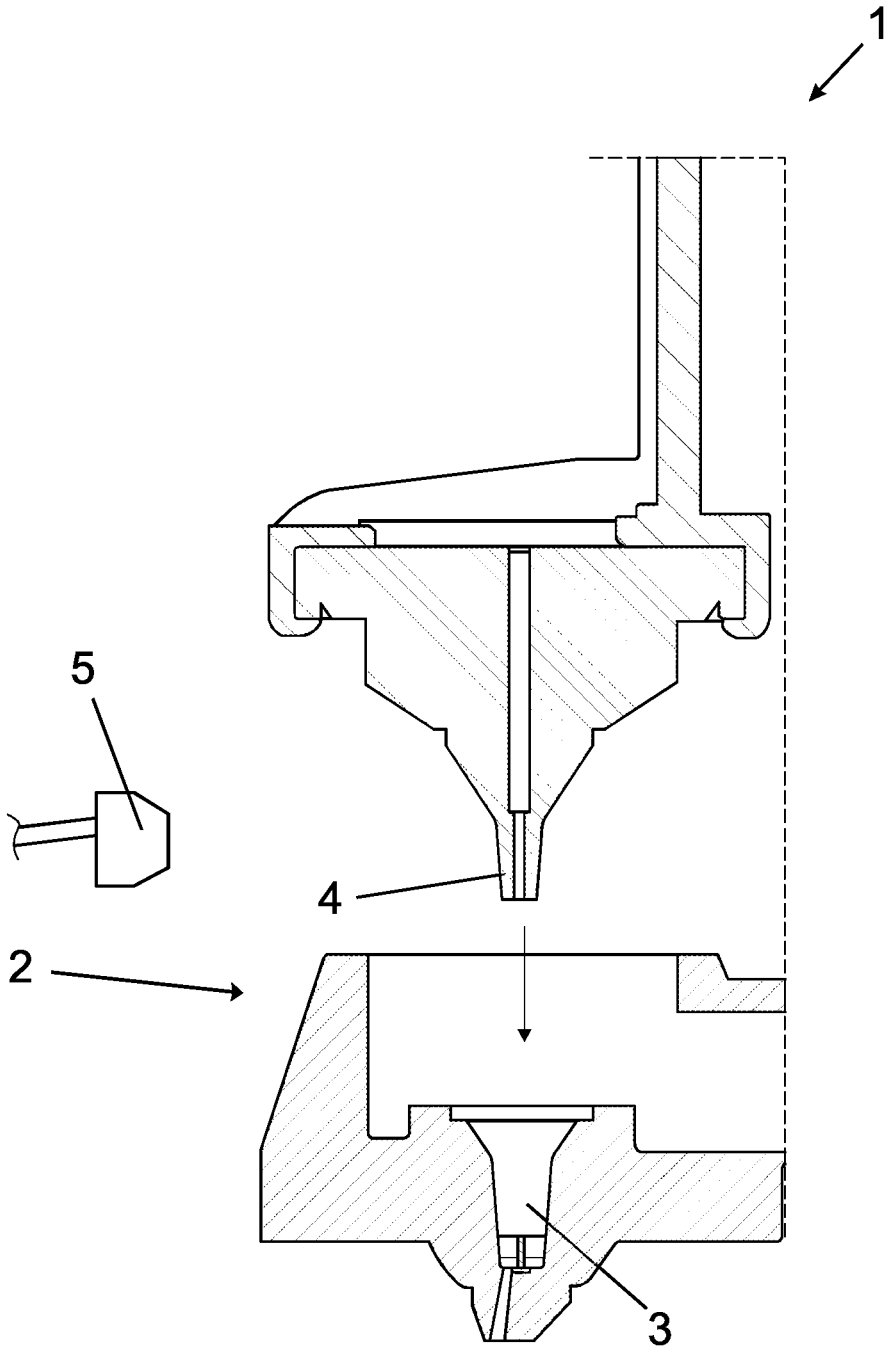
FIG. 2 shows a schematic, cross-sectional view of the spinning position shown in FIG. 1 with an air spinning nozzle in an open state for cleaning.

A first embodiment of a spinning position 1 of an air-spinning machine, shown in FIGS. 1 and 2, has an air spinning nozzle 2 in which a spinning cone is arranged as a yarn forming element 4 within a vortex chamber 3. In order to be able to produce a yarn by air spinning by means of the spinning position 1, a fibre band is first drafted by means of a multiple roller drafting system and the drafted fibre band thus obtained is subsequently fed to the air spinning nozzle 2 via a fibre band entrance 7. According to this preferred embodiment example, after being introduced via the fibre band entrance 7, the fibre band is guided around a needle 8 extending in the fibre band transport direction in a manner that has already been disclosed in the direction of the yarn forming element 4 approximately as far as the take-up duct opening of that yarn forming element 4. Alternatively to the needle 8, according to another preferred embodiment, it is possible to arrange a pair of tweezers which are generally known. Inside the vortex chamber 3 of the air spinning nozzle 2, the outer fibres of the fibre band are wound around an inner fibre core by means of a vortex air flow generated by air spinning nozzles 2 in the area of an inlet mouth of the air spinning nozzle 2, so that an air-spun yarn-specific structure of a parallel yarn core and wrap fibres lying at a certain angle results, the wrap fibres being decisive for the desired strength of the yarn.

If a synthetic fibre material is used for air spinning the yarn, individual detached fibres, fibre residues and possibly auxiliary materials will accumulate on the surface of the yarn forming element 4 over time, which may reduce the quality and strength of the spun yarn.

In order to prevent this, a cleaning nozzle 5 is arranged in a stationary position outside the vortex chamber 3 in the area of the spinning position 1, in which case this cleaning nozzle 5 does not influence the air spinning process in the closed air spinning nozzle 2 due to its arrangement (see FIG. 1). However, when the air spinning nozzle 2 is opened, for example after a thread break or a cut of the spun yarn, the yarn forming element 4 is moved to a cleaning position when the air spinning nozzle 2 is opened, in which cleaning position an outlet opening of the stationary cleaning nozzle 5 is aligned with a side surface of the yarn forming element 4, so that the surface of the yarn forming element 4 can be cleaned by means of the cleaning nozzle 5 (see FIG. 2).

For this purpose, according to this first embodiment, at least one aqueous cleaning fluid is atomized by means of the cleaning nozzle 5 and directed as a spray mist onto the yarn forming element 4 so that the deposits adhering to the surface of the yarn forming element 4 can be removed.

Preferably, however, such cleaning is carried out by means of a cleaning cycle which can be performed once or repeated several times. A first possible cleaning cycle provides that first, by means of the cleaning nozzle 5, a cleaning fluid for removing deposits is sprayed onto the surface of the yarn forming element 4 and then, also by means of the cleaning nozzle 5, a pulse of compressed air is directed onto the surface of the yarn forming element 4 to remove the mixture of the cleaning fluid and the loosened adhesions and to dry the surface of the yarn forming element 4. Alternatively, according to a further embodiment, instead of the cleaning fluid, a foam is applied to the surface of the yarn forming element 4 via the cleaning nozzle 5, the foam being mixed with a liquid that has a non-stick effect. The yarn forming element 4 with the non-stick liquid applied to it is dried by means of the subsequent compressed air pulse.

In an alternative cleaning cycle, a pulse of compressed air is first directed at the surface of the yarn forming element 4 to remove loose adhesions. Cleaning is then carried out by means of a cleaning medium such as the cleaning fluid in order to remove the adhesions that have not been loosened by means of the compressed air. Finally, a removal of the mixture of the cleaning fluid and the dissolved adhesions and a drying of the surface of the yarn forming element 4 by means of a renewed application of compressed air is preferably also carried out. Furthermore, the same cleaning nozzle 5 is preferably used for all cleaning steps.

Figure 3:
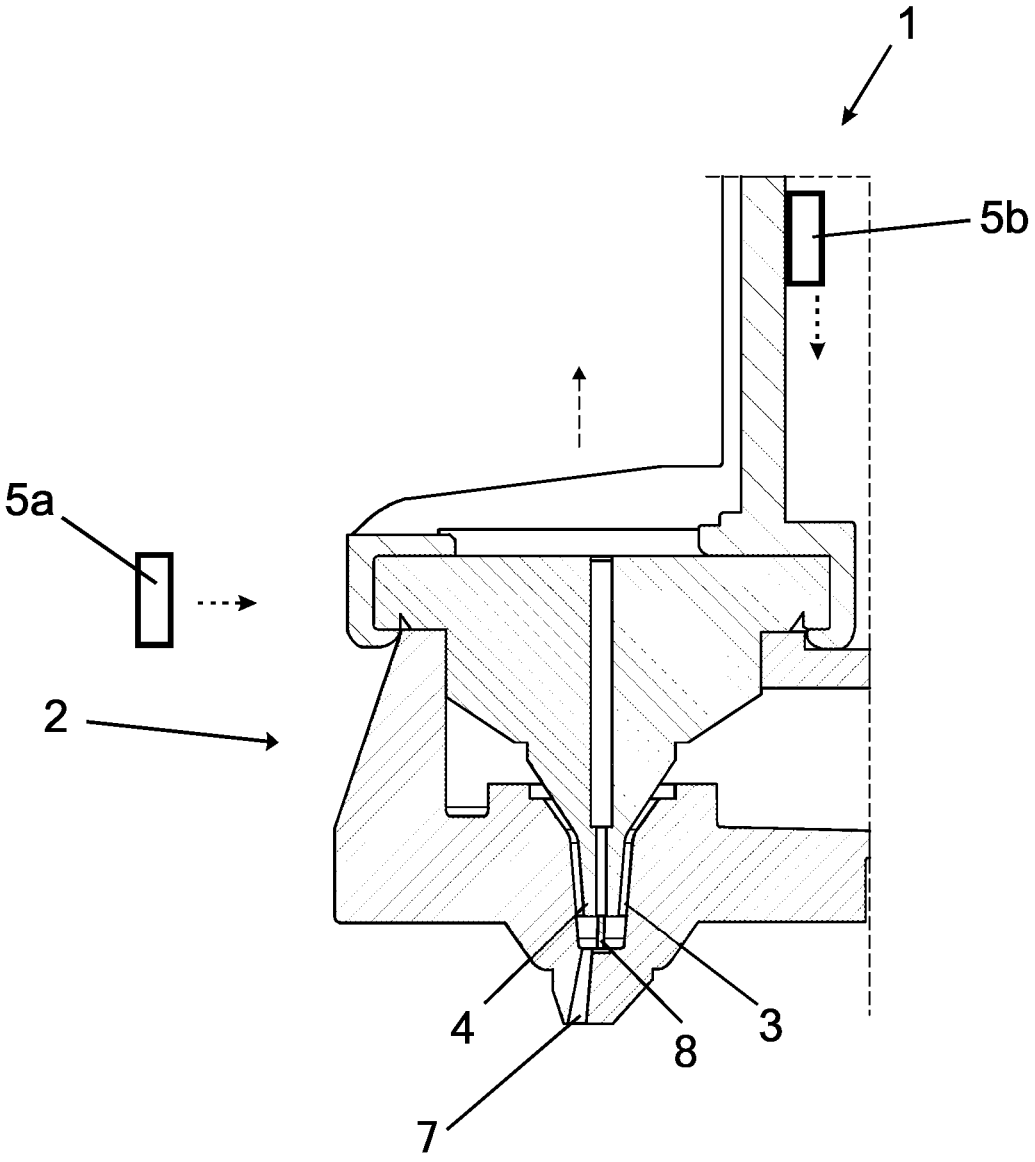
FIG. 3 shows a schematic, cross-sectional view of a second embodiment of a spinning position of an air-spinning machine having an air spinning nozzle in a closed state for yarn formation.
Figure 4:
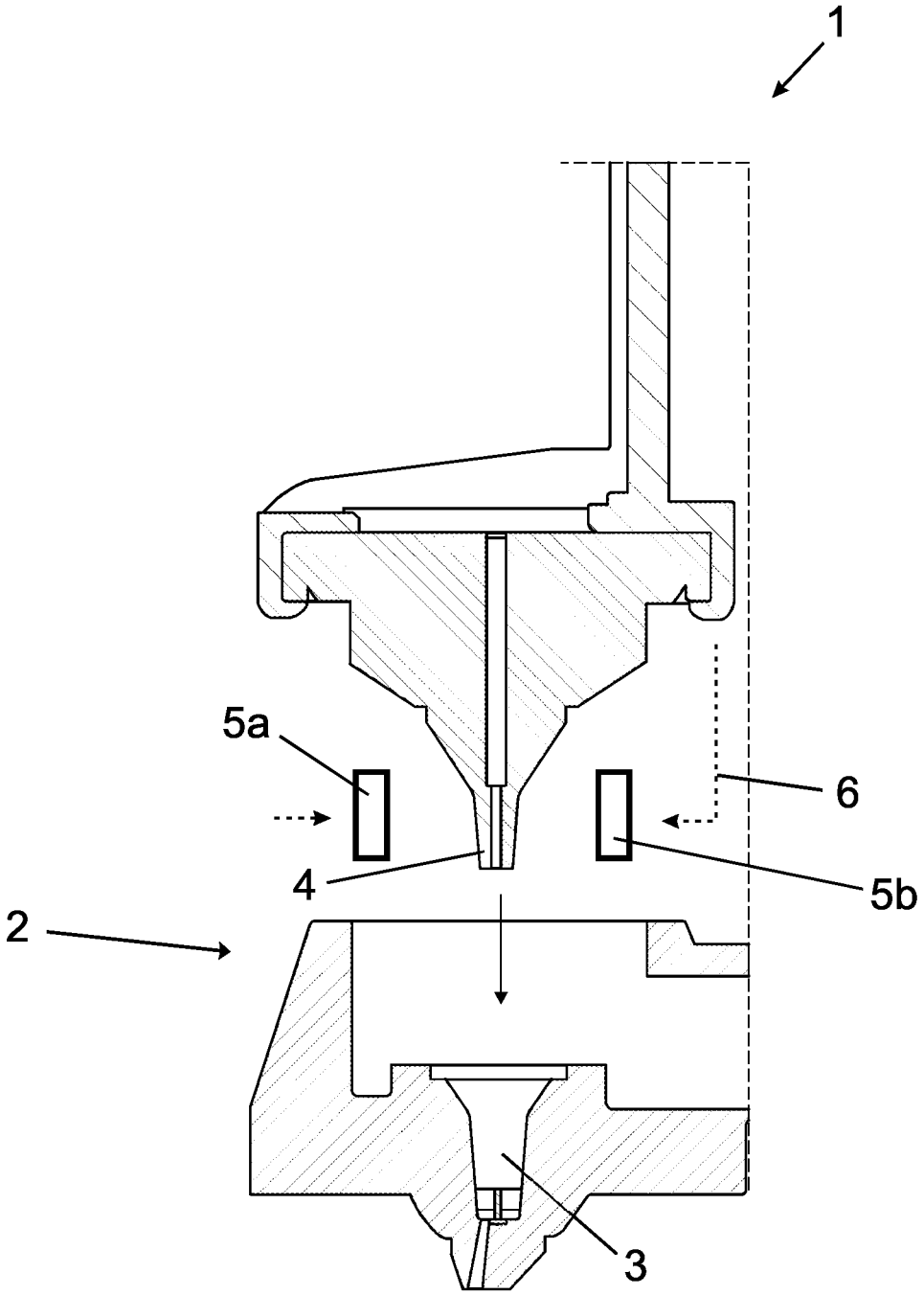
FIG. 4 shows a schematic, cross-sectional view of the spinning position shown in FIG. 3 with an air spinning nozzle in an open state for cleaning.

A second embodiment of a spinning position 1 of an air-spinning machine, illustrated in FIGS. 3 and 4, differs significantly from the first embodiment in that two movable cleaning nozzles 5*a, b* are provided instead of one stationary cleaning nozzle 5.

In this case, a first cleaning nozzle 5*a* is arranged so as to be linearly displaceable in the direction of a side surface of the yarn forming element 4, this cleaning nozzle 5*a*, for cleaning the surface of the yarn forming element 4 after the air-spinning nozzle 2 has been opened, during which the yarn forming element 4 is moved into a cleaning position, is also displaced linearly into a cleaning position and thus at least one cleaning medium, in particular a cleaning fluid, an aerosol, a foam, an emulsion or a gas, can be applied to the yarn forming element 4 in the immediate vicinity of the surface of the yarn forming element 4.

Furthermore, this cleaning nozzle 5*a* can also be arranged to swivel around the yarn forming element 4, at least in sections, so that a cleaning fluid can be applied around the circumference of the surface of the yarn forming element 4.

The second cleaning nozzle 5*b* is both linearly displaceable and can be swivelled towards the surface of the yarn forming element 4 by means of a swivelling device 6 (shown only schematically by an arrow in FIG. 4). The second cleaning nozzle 5*b* is linearly displaced even during the opening of the air spinning nozzle 2 and the accompanying positioning of the yarn forming element 4 into a cleaning position. After the yarn forming element 4 has reached the cleaning position, the cleaning nozzle 5*b* is then swivelled towards the surface of the yarn forming element 4 by means of the swivelling device 6 so that cleaning can be performed by means of both cleaning nozzles 5*a*, 5*b*.

In the case of cleaning by means of several cleaning nozzles 5*a*, 5*b*, cleaning can be carried out with all cleaning nozzles 5 at the same time, or the cleaning nozzles 5*a*, 5*b* can be used for cleaning one after the other. Furthermore, it is also conceivable that both cleaning nozzles do not use the same cleaning medium at the same time or immediately one after the other, but that a cleaning cycle independent of the other cleaning nozzles 5*b*, 5*a* can also be carried out by means of each cleaning nozzle 5*a*, 5*b*.

LIST OF REFERENCE SIGNS

1 Spinning position
2 Air spinning nozzle
3 Vortex chamber
4 Yarn forming element
5 Cleaning nozzle
6 Swivelling device
7 Fibre band entrance
8 Needle It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A spinning position of an air-spinning machine comprising:

an air spinning nozzle having a yarn forming element disposed within a vortex chamber for producing a yarn from a fibre band supplied to the air spinning nozzle, in which case the air spinning nozzle can be transferred from a closed state for yarn formation to an open state in which the yarn forming element can be cleaned, a cleaning nozzle for cleaning the yarn forming element in the opened state of the air spinning nozzle, in which case the cleaning nozzle is movable relative to the yarn forming element by a swivelling device at least between a rest position and a cleaning position for cleaning the yarn forming element and is designed to be positionable and/or alignable by the swivelling device in such a way that at least in the opened state of the air spinning nozzle, the yarn forming element in the cleaning position of the cleaning nozzle can have a cleaning medium applied to it frontally and/or laterally over at least over part of its surface.

2. The spinning position of an air-spinning machine according to claim 1, characterised in that at least one cleaning nozzle is arranged outside the vortex chamber and/or is in a stationary arrangement.

3. The spinning position of an air-spinning machine according to claim 1, characterised in that the cleaning nozzle can be moved outside the vortex chamber.

4. The spinning position of an air-spinning machine according to claim 3, characterised in that the cleaning nozzle can be rotated at least partially circumferentially around the yarn forming element by the swivelling device.

5. The spinning position according to claim 3, characterised in that the cleaning nozzle can be moved by the swivelling device in at least two mutually different directions relative to the yarn forming element.

6. A method for cleaning a yarn forming element of an air spinning nozzle with the yarn forming element arranged inside a vortex chamber for manufacturing a yarn from a fibre band supplied to the air spinning nozzle, the air spinning nozzle being transferrable from a closed state for yarn formation to an open state in which the yarn forming element can be cleaned, the method comprising:

opening of the air spinning nozzle to render the yarn forming element located in the vortex chamber accessible, movement of a cleaning nozzle for cleaning the yarn forming element relative to the yarn forming element by a swivelling device from a rest position to a cleaning position, and application of at least one cleaning medium to the yarn forming element frontally and/or laterally over at least over part of its surface by means of the cleaning nozzle being positioned and/or aligned in the cleaning position respectively.

7. The method according to claim 6, characterised in that a movement of the yarn forming element and/or of the cleaning nozzle into the cleaning position occurs with an initiation of the opening process of the air spinning nozzle, during the opening of the air spinning nozzle and/or after the opening of the air spinning nozzle.

8. The method according to claim 6, characterised in that a movement of the yarn forming element takes place in such a way that the cleaning nozzle is in the cleaning position at the end of the opening process.

9. The method according to claim 6, characterised in that a cleaning of the yarn forming element takes place in the course of a spinning interruption.

10. The method according to claim 6, characterised in that an aqueous cleaning fluid, an aerosol, a foam, an emulsion or a gas is used as the cleaning medium.

11. The method according to claim 6, characterised in that either, following cleaning by a cleaning fluid, an aerosol, a foam or an emulsion, the yarn forming element is subsequently acted upon in a second cleaning step by a gas stream, or that, following cleaning by a gas stream, the yarn forming element is subsequently acted upon in a second cleaning step by a cleaning fluid, an aerosol, a foam or an emulsion via the cleaning nozzle.

12. The method according to claim 6, characterised in that cleaning of the yarn forming element is carried out first by a first gas stream for removing loose particles from the yarn forming element, subsequently by a cleaning fluid, an aerosol, a foam or an emulsion for loosening adhering particles, and following that by a second gas stream for final cleaning and drying of the yarn forming element.

13. The method according to claim 12, characterised in that the cleaning is performed by the cleaning fluid, aerosol, foam or emulsion and by the first gas stream and/or the second gas stream by the same cleaning nozzle.

14. The method according to claim 6, characterised in that a cleaning of the yarn forming element takes place after at least one thread break, after at least one cut of the yarn, during a removal of a take-up package wound by the air-spun yarn and/or during a change of a spinning can.

* * * * *